United States Patent [19]

Ivett

[11] 4,143,596

[45] Mar. 13, 1979

[54] LITHOGRAPHIC PRESS DAMPENING SYSTEM

[76] Inventor: Robert W. Ivett, 17425 Stare St., Northridge, Calif. 91325

[21] Appl. No.: 793,830

[22] Filed: May 4, 1977

[51] Int. Cl.[2] ..... B41F 7/30

[52] U.S. Cl. ..... 101/148; 101/366

[58] Field of Search ..... 101/147, 148, 349, 350, 101/366

[56] References Cited

U.S. PATENT DOCUMENTS

| | | | |
|---|---|---|---|
| 2,868,118 | 1/1959 | Dahlgren | 101/147 |
| 2,986,337 | 5/1961 | Clare | 101/148 X |
| 3,062,138 | 11/1962 | Worthington | 101/350 |
| 3,094,065 | 6/1963 | Roberts | 101/148 |
| 3,096,710 | 7/1963 | Wojciechowski et al. | 101/148 |
| 3,257,940 | 6/1966 | Stoudwick | 101/148 |
| 3,545,379 | 12/1970 | Norton | 101/148 |
| 3,759,175 | 9/1973 | Alsop | 101/366 X |
| 3,926,115 | 12/1975 | Alsop | 101/148 |

OTHER PUBLICATIONS

Gegenheimer, "What's New in Offset Dampering Systems", Island Printer, Feb. 1964, pp. 58–59 & 104.

*Primary Examiner*—Edward M. Coven
*Attorney, Agent, or Firm*—Warren T. Jessup

[57] ABSTRACT

A dampening system for a lithographic press, comprised of a brush roller contacting a fountain roller immersed in a fluid. The brush roller is contacted by an elongate flicker bar transferring the fluid to a vibrator roller for application to a plate cylinder by a form roller. Drive means operate the fountain roller which is geared to the brush roller. The ratio of the gearing is such that the brush roller is driven at an overspeed condition relative to the fountain roller.

7 Claims, 2 Drawing Figures

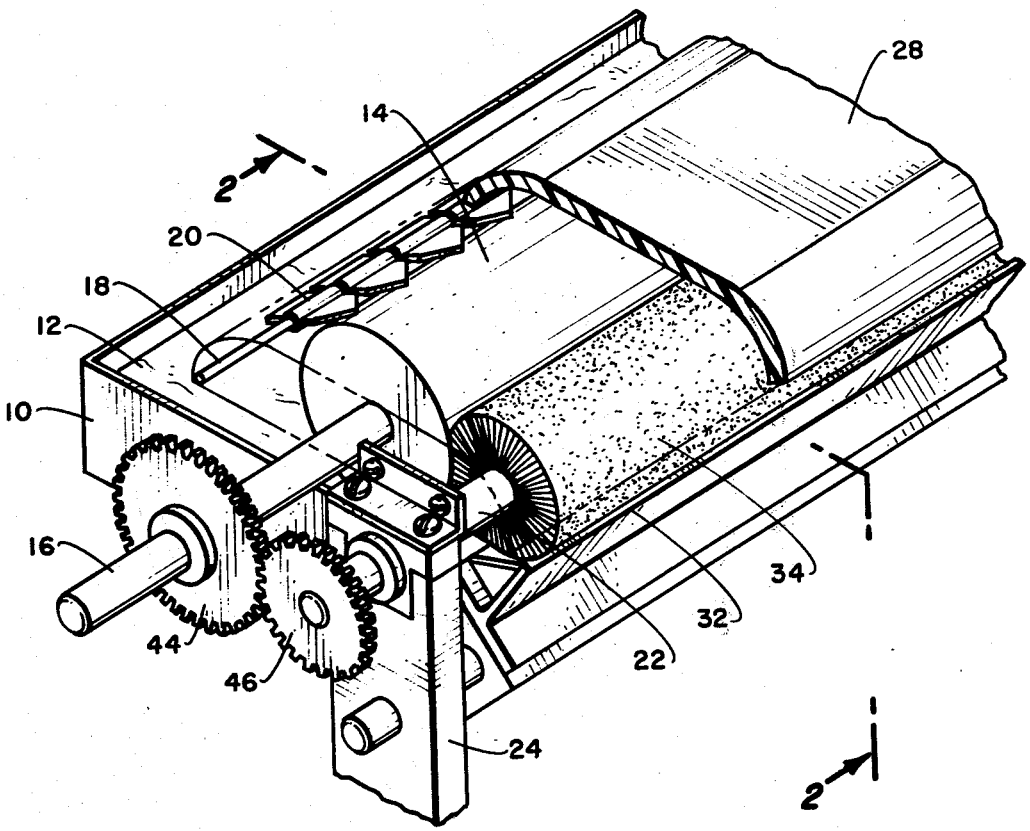

LITHOGRAPHIC PRESS DAMPENING SYSTEM

BACKGROUND OF THE INVENTION

This invention relates to lithographic press dampening systems, and more particularly relates to lithographic dampening systems utilizing a brush roller.

In a lithographic press a plate cylinder has non-printing areas coated with a film of fluid from a dampening system, usually including water, and the printing areas treated with an ink from an ink form roller. The ideal dampening system rapidly establishes the proper ink-to-fluid balance so that a uniform sharp image is produced by the ink transferred to the non-water treated areas. It is therefore essential that the dampening system provide a uniform balanced distribution on the water or dampening fluid receptive areas of the plate cylinder. These dampening systems have been the major source of production difficulties in lithographic presses and for that reason many systems have been created to solve the problems of dampening, such as problems with ink roller stripping from improper ink/water balance, as well as image distortion, ink chalking and streaking.

Systems devised for providing uniform dampening include an intermittent feed dampening system in which a ductor roller oscillates between a water pan or fountain roller and a vibrator roller. This is a typical conventional dampening system. Another system for dampening includes a flap roller system in which a fountain roller having flaps intermittently contacts the vibrator roller. Other systems including brush roller systems, as well as spray systems, have been devised, but while being successful have not been entirely satisfactory. The brush roller systems provide great promise and include a system having a brush picking up fluid from a fountain and engaging a deflector bar to create a fine spray mist to transfer the fluid or water to a vibrator roller. A variety of modifications has been proposed for the brush roller system, such as a brush roller wiping a fountain roller being driven in opposite directions. Another modification has been to use a weir brush in which a leading edge of the fountain acts as a deflector bar causing a misting of the fluid on the brush. Other systems proposed include a spiral-wound brush and a spiral rib on the fountain roller deflecting a stationary brush. While these systems have effected some improvements, they have not been entirely satisfactory.

SUMMARY OF THE INVENTION

The purpose of the present invention is to provide a lithographic dampening system to provide uniform balanced dampening with a minimum of difficulties.

The present invention is a dampening system employing a fountain roller picking up a fluid, usually water, which is transferred to a tangentially interfering brush roller being driven counter to the fountain roller. The brush roller in turn encounters a flicker or deflector bar which creates a spray mist transferring the dampening fluid to a vibrator roller. The flicker bar is mounted beneath the brush roller providing some of the advantages of previous dampening systems with none of the disadvantages. The elongate flicker bar contacting the brust roller is formed as the edge of a trough for catching contaminants and excess water scraped off the brush roller by the flicker bar.

The system is driven by driving the shaft of the fountain roller, which is geared, to directly drive the brush roller in the opposite direction. In addition, the brush roller is driven at a slightly overspeed condition relative to the fountain roller by a preselected gear ratio. Water stops or drags are provided to wipe the fountain roller during the dampening process to provide an even distribution of fluid.

It is one object of the present invention to provide a lithographic dampening system employing a brush roller.

Another object of the present invention is to provide a lithographic dampening system employing a fountain roller contacting a brush roller in which the fluid is transferred by a flicker bar.

Still another object of the present invention is to provide a lithographic dampening system employing a brush roller which is geared to the fountain roller.

Yet another object of the present invention is to provide a lithographic dampening system employing a brush roller driven at a speed slightly in excess of the fountain roller.

Another object of the present invention is to provide a lithographic dampening system which minimizes contamination of the dampening fluid or the fluid transfer rollers.

Other objects, advantages and novel features of the invention will become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
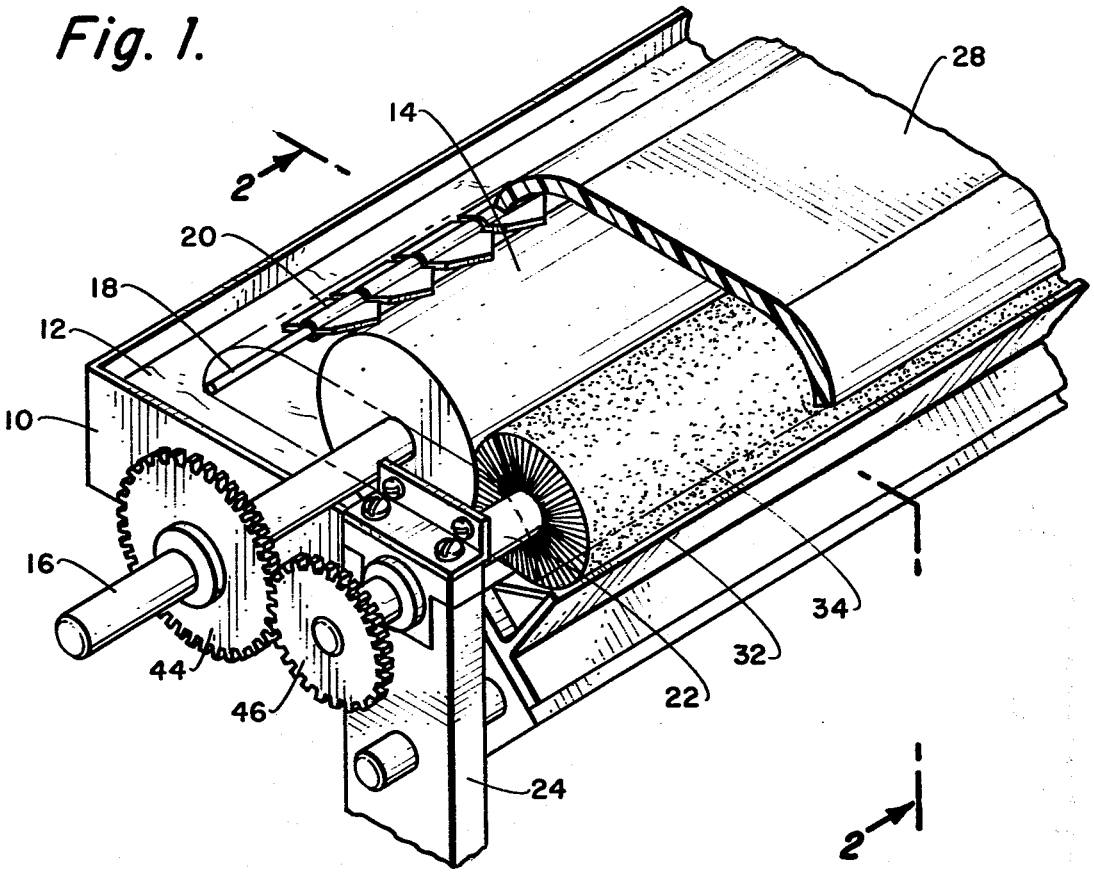
FIG. 1 is a perspective view of a partial section of the lithographic dampening system of the invention.
Figure 2:
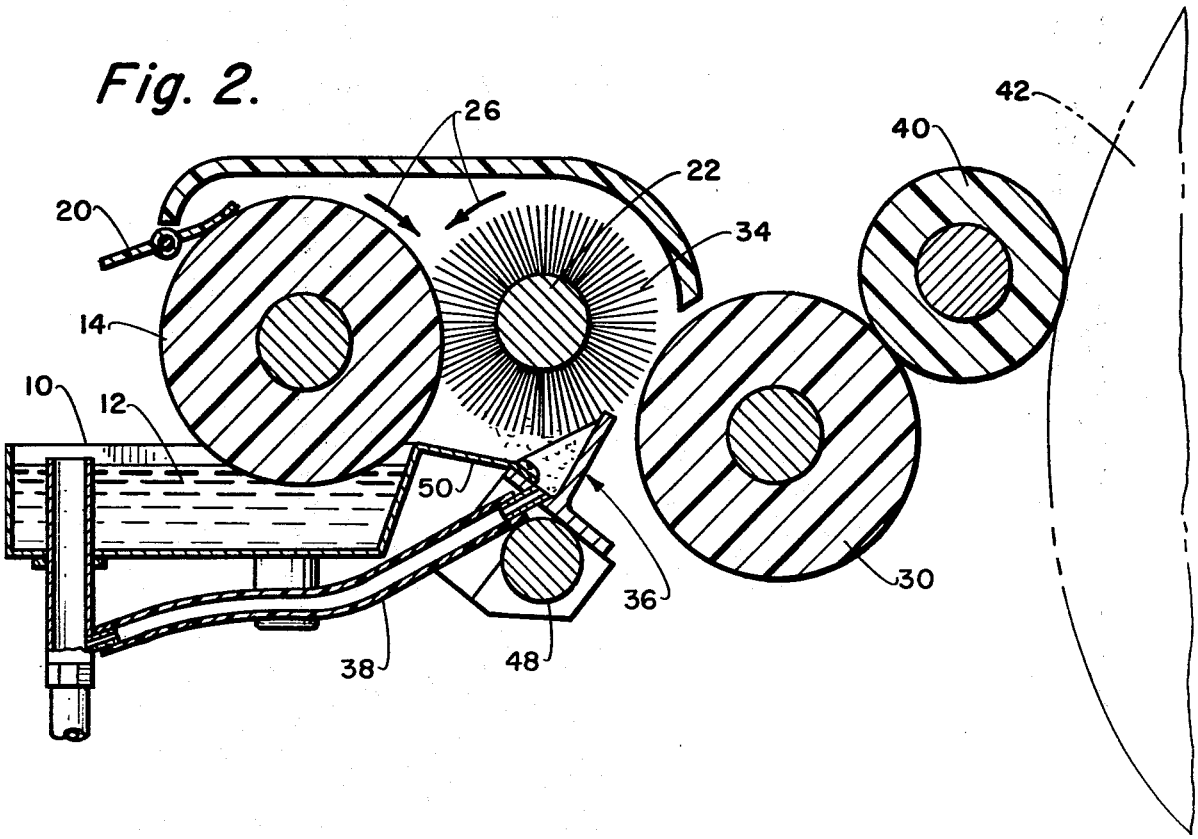
FIG. 2 is a sectional side elevation of the lithographic dampening system of FIG. 1.

The lithographic dampening system is illustrated in FIG. 1 in which 10 is a fountain for storing a dampening fluid 12. The dampening fluid is picked up by a fountain roller 14 for transfer to the plate cylinder 42 (shown in phantom) through a series of rollers including a form roller 40 and vibrator or oscillating roller 30. The fountain roller 14 is mounted on a shaft 16 driven by a suitable drive motor (not shown). A bar 18 mounted on the dampening system has adjustable water stops or drags 20 for smoothing the fluid picked up by the fountain roller 14.

The fountain roller 24 transfers the dampening fluid as well as controls the relative speed of the two rollers. This is because uniform dampening is greatly improved with the brush roller 22 being driven at a predetermined overspeed relative to the fountain roller 14. The greatest efficiency is achieved at an overspeed condition of approximately 5%. Thus, the gear ratio of gears 44 and 46 is selected to provide an overspeed condition of the brush roller 22 relative to the fountain roller 14 at this 5% value. While the value may vary from sightly over zero up to 10%, a range of 3% up to 10% is preferred; the 5% figure was found to be most satisfactory.

With the dampening system shown all the advantages of a brush roller type system have been realized with none of the disadvantages. The excessive moisture problem caused by having the brush in direct contact with the fluid has been reduced and the need for an accumulator roller to smooth out excessive moisture on the vibrator roller has been eliminated. With the fountain roller 14 and brush roller rotating in interfering engagement counter to each other and the brush roller at a slight overspeed condition, the bristles 34 tend to have a slight wiping action against the fountain roller picking up a uniform volume of the dampening fluid for distribution to the vibrator roller 30. The system also eliminates intermittent feed of dampening at low cost and with a minimum of maintenance and provides a continuous flow of fountain solution to the water oscillator or vibrator. With the flicker bar 32 mounted beneath the brush roller 22, very close tolerances of the brush roller to the vibrator roller can be achieved with the flicker bar being incorporated into and as an integral part of a collecting trough. The collecting trough 36 is mounted on a shaft 48 supported in the frame 24 beneath a lip 50 on the fountain for run-off of contaminants or excessive fluid. No run-off of excessive fluid or contaminants is allowed to flow back into the fountain 10.

Thus the system disclosed provides improved, uniform dampening with a minimum of contamination of the dampening fluid, the printing press vibrator form rollers, or plate cylinder.

Obviously, many modifications and variations of the present invention are possible in light of the above teachings. It is therefore to be understood that the full scope of the invention is not limited to the details disclosed herein, but may be practiced otherwise than as specifically described.

What is claimed is:

1. In a lithographic press dampening system in which a fluid is transferred to a plate roller through a series of rollers, the improvement comprising:

a fountain containing a dampening fluid;

a fountain roller partially immersed in said fluid for picking up and transferring said fluid;

a brush roller having bristles in a continuous contact with said fountain roller for transferring said fluid;

an elongate flicker bar adjacent to said brush roller engaging and bending said bristles for deflecting the fluid from said brush roller to said series of rollers;

first means for rotatably driving said fountain roller; and second means for driving said brush roller counter to and at an overspeed with respect to said fountain roller whereby the bristles of said brush have a slight wiping action against the fountain roller picking up a uniform volume of dampening fluid;

whereby said fluid is transferred to said plate cylinder from said series of rollers.

2. The dampening system according to claim 1 including a collecting trough beneath the flicker bar and brush roller for collecting and disposing of excess fluid dislodged from said brush roller.

3. The dampening system according to claim 2 wherein said flicker bar comprises an elongate edge of said trough beneath said brush roller.

4. The dampening system according to claim 1 including:

linking means linking the second means to the first means to maintain the overspeed condition substantially constant.

5. The dampening system according to claim 4 wherein said linking means comprises:

a shaft for driving the fountain roller;

a gear on said fountain roller shaft;

a second shaft for driving said brush roller;

a second gear on said brush roller shaft engaging said first gear; and said first and second gears having a ratio whereby said brush roller is driven at an overspeed relative to the fountain roller.

6. The dampening system according to claim 5 wherein said gear ratio may be selected to provide an overspeed condition between slightly more that 3% up to 10%.

7. The dampening system according to claim 5 wherein the gear ratio is selected to provide an overspeed condition of approximately 5%.

* * * * *